US005671672A

United States Patent [19]

Savva

[11] Patent Number: 5,671,672

[45] Date of Patent: Sep. 30, 1997

[54] IMAGE PRINTER

[76] Inventor: Konstantine George Savva, 15/28-30 Trafalgar Street, Brighton-Le-Sands, NSW, Australia, 2216

[21] Appl. No.: 541,454

[22] Filed: Oct. 10, 1995

[51] Int. Cl.[6] ..... B41F 15/04; B05C 17/06

[52] U.S. Cl. ..... 101/127.1; 101/115

[58] Field of Search ..... 101/127.1, 115, 101/35, 128.1

[56] References Cited

U.S. PATENT DOCUMENTS

| | | | |
|---|---|---|---|
| 270,969 | 1/1883 | Moreau | 101/394 |
| 570,928 | 11/1896 | Harding et al. | 101/394 |
| 3,416,445 | 12/1968 | Krueger, Jr. | 101/128.1 |
| 5,111,743 | 5/1992 | Umaba et al. | 101/127 |
| 5,203,706 | 4/1993 | Zamir | 434/172 |
| 5,347,925 | 9/1994 | Holderegger | 101/127 |
| 5,375,517 | 12/1994 | Graener et al. | 101/129 |
| 5,398,602 | 3/1995 | Taylor | 101/129 |

FOREIGN PATENT DOCUMENTS

| | | | |
|---|---|---|---|
| 2916644 | 10/1979 | Germany | 101/128.1 |

*Primary Examiner*—Edgar S. Burr
*Assistant Examiner*—Dave A. Ghatt
*Attorney, Agent, or Firm*—Townsend and Townsend and Crew LLP

[57] ABSTRACT

An image printing apparatus (10) comprises a frame (11) to be fixed by suction cups (15) upon a surface (25) to receive an image. The frame (11) defines a space to receive a screen print frame (16). The position of screen print frame (16) may be adjusted by manipulation of the adjustable positioning cams (12, 13). Once accurately positioned, positioning cams (12, 13) are fixed by rotation of tightening knobs (18). An image of a selected color may then be printed upon the surface (25) using screen print frame (16). For overlaid prints in other colors, frame (16) may be removed, leaving at least some of the adjustable positioning cams (12, 13) in place such that a further screen print frame (16) of identical size and shape may be positioned accurately with respect to the previously printed image by contact with the positioning cams. Images of multiple colors may be printed in this manner.

15 Claims, 2 Drawing Sheets

IMAGE PRINTER

FIELD OF THE INVENTION

The following invention relates to an image printer. More particularly, though not exclusively, the invention relates to a multiple image screen printing apparatus adapted to accurately print images of more than one color upon a substantially flat surface.

Where a sign for example is to be printed upon a shop front window, a conventional screen printer may be used. The screen printer is simply held by a person in position against the glass and the image applied in a conventional manner. Such a process of forming a sign upon a window is limited to signs of one color only. If it were desired to print a second color over the first printed color, it would be near impossible with existing screen printing devices to accurately align the second screen printer with the existing image.

OBJECT OF THE INVENTION

It is the object of the present invention to overcome or substantially ameliorate the above disadvantages and/or more generally to provide an improved image printing apparatus.

DISCLOSURE OF THE INVENTION

There is disclosed herein an image printing apparatus comprising:

a frame, a fastening device or devices fixed to the frame and adapted to temporarily hold the frame stationary relative to a surface, and adjustable positioners mounted to the frame and adapted to cooperate with a printing screen so as to position the same ready for application of an image to said surface.

Preferably, the fastening device or devices comprise suction cups, typically of the type used by glaziers to lift a pane of glass. Such suction cups comprise a lever which may be activated to draw the centre of the cup outwardly from the glass, thus creating a vacuum between the cup and the glass.

Alternatively, the fastening device or devices might be adhesive tape, magnetic devices, or any means by which a frame may be fixed to a substantially flat surface. For example, where magnetic devices are used, magnets may be affixed to the frame and steel plates placed on the opposing side of the substantially flat surface (such as glass). Alternatively, the frame may comprise steel components having inherent magnetic conduction, and magnets may be placed behind the glass to attract the frame thereto.

Preferably, the adjustable positioners comprise a series of threaded fasteners passing through the frame and adapted to bear against edges of the printing screen. Such threaded fasteners might be provided with lock nuts to set the fasteners to the frame once adjusted.

Alternatively, the adjustable positioners might comprise a series of cam devices rotatably mounted to the frame and having a camming surface adapted to bear against the edge of the printing screen. Such camming devices might comprise a locking nut upon a threaded shaft upon which the camming devices pivot.

By use of the above disclosed apparatus, a multiple color image may be printed upon a vertical glass surface or the like by way of the following disclosed method.

There is further disclosed herein a method of printing an image of multiple color upon a substantially flat surface, the method comprising positioning the frame of the above disclosed image printing apparatus adjacent the surface and printing a first colored image upon the surface, removing the printing screen from the frame without readjusting preselected ones of said adjustable positioners, and mounting a further printing screen to the frame and aligning the further screen with the first colored image by contacting the further screen with said non-readjusted positioners, and printing a second colored image.

More generally, there is further disclosed herein a method of printing an image upon a substantially flat surface, said method comprising the steps of utilising the above disclosed image printing apparatus by temporarily fixing the frame to the substantially flat surface, adjusting the printing screen relative to the frame, and applying an image to the surface by use of the printing screen. Apart from the usual spectrum of colors, the term "colored image" is intended to encompass black and white.

BRIEF DESCRIPTION OF THE DRAWINGS

A preferred form of the present invention will now be described by way of example with reference to the accompanying drawings, wherein.

DISCLOSURE OF THE PREFERRED EMBODIMENT

Figure 1:
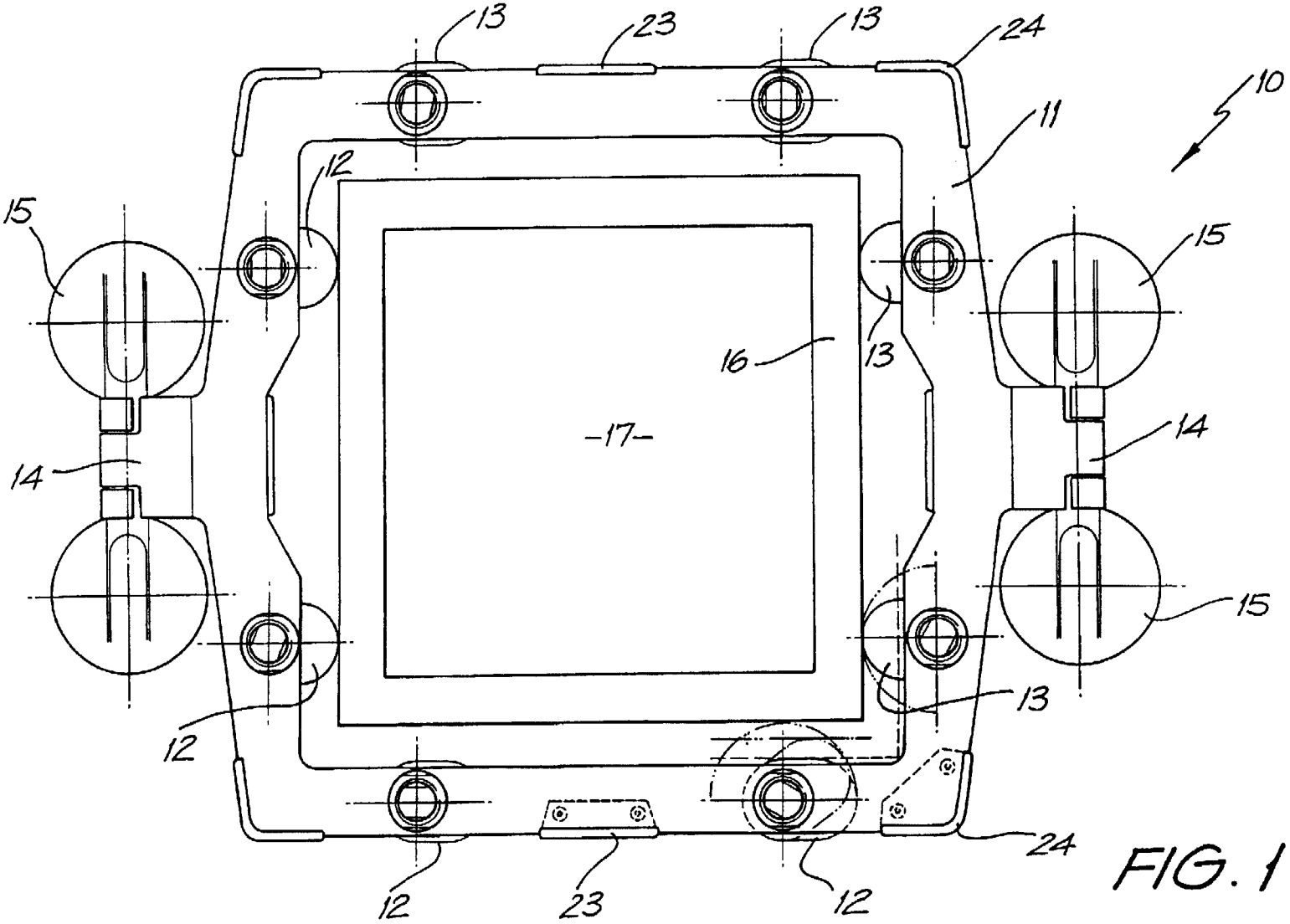
FIG. 1 is a schematic plan view of an image printing apparatus.
Figure 2:
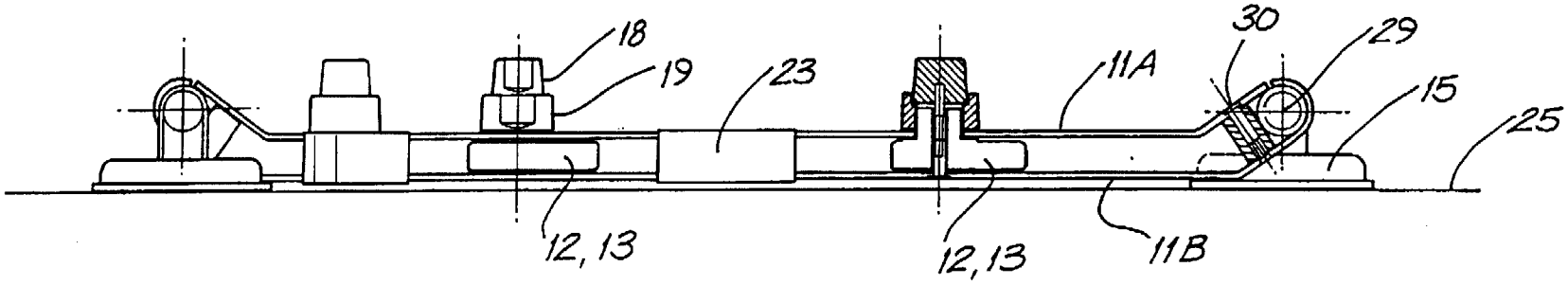
FIG. 2 is a schematic elevational view of the apparatus of FIG. 1.

In FIG. 1 there is schematically depicted an image printing apparatus 10. Apparatus 10 comprises a frame 11, typically fabricated in steel, aluminium, plastics or any suitably rigid material. The frame 11 is generally rectangular, though may be square or any other shape generally providing a hollow space within which a screen printing frame 16 may be received.

The screen print frame 16 may be a conventional frame. In any event, the screen print frame 16 is to be adjustably mounted to the frame 11 by interaction with adjustable positioners 12 and 13. Although eight adjustable positioners in total are shown, in an alternative embodiment, positioners 12 for example might be omitted. The function of positioners 12 and 13 shall be described below.

Figure 3:
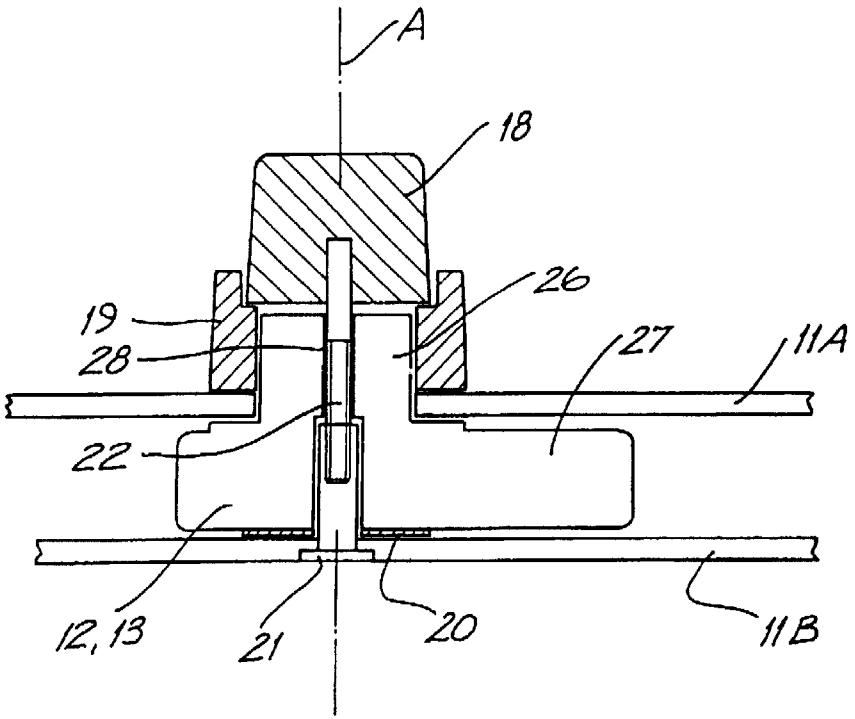
FIG. 3 is a schematic detailed elevational view of one of the positioning members and its arrangement with the frame of the apparatus of FIGS. 1 and 2.

Each adjustable positioner 12, 13 comprises a cam pivotally affixed to the frame 11. As an alternative however, threaded fasteners may pass through the frame to abut against the edges of the print screen 16. As shown in FIG. 3, each positioning device 12, 13 comprises a cam 27 sandwiched between upper surface 11A and lower surface 11B of frame 11. Extending upwardly from cam 27 is a boss 26 having a hole 28 drilled therethrough. Hole 28 is colinear with axis A defining the pivot axis of cam 27. Extending through hole 28 is an externally threaded member 22 threadingly engaged with a recessed nut 21 in lower frame member 11B. Secured to the threaded shaft 22 is a tightening knob 18. Each tightening knob 18 may be provided with an Alan Key recess or other keyed means cooperable with a matching purpose-designed tool adapted to turn the knob 18.

Communicating upward and downward movement of tightening knob 18 with the upper surface 11A of frame 11 is an annular ring 19. Situated between the adjustable positioner 12, 13 and lower frame member 11B is a wave spring 20.

Located at various positions about the perimeter of frame 11 are spacers 23 and corner spacers 24. These spacers serve to secure the two frame pans 11A and 11B together at a predetermined spacing. Upon rotation of tightening knobs 18, after having located cam 27 against the edge of screen print frame 16, annular ring 19 presses upper surface 11A tightly against spacer 12, 13 to prevent rotation thereof.

Extending from frame 11 is a pair of arms 14, to each of which is attached a pair of suction cups 15. Suction cups 15 at one end of the apparatus 10 are mutually interengaged by a shaft 29. Shaft 29 extends through an aperture in arm 14. The aperture is defined as a space between upper frame member 11A and lower frame member 11B. Although a tight fit may exist between shaft 29 and its provided space as a result of tightening of screw 30, it may be desired to change the pivotal orientation of each suction cup 15 by rotation of shaft 29. Suction cups 15 might typically be of the type used by glaziers to lift a pane of glass. Such cups comprise a lever to draw the centre of the cup outwardly from the glass to create a zone of low pressure between the cup and the glass for strong attachment. As an alternative to suction cups 15, other forms of attachment devices may be used. For example, strong permanent magnets might be provided, or double sided adhesive tape or the like.

As a further alternative, the arms 14 may be disposed with altogether and magnetic as devices simply used to hold the steel frame 11 to the glass by being placed behind the glass relative thereto. To further prevent slippage of the frame relative to the glass, a number of resilient footings or pads may be applied to the under side of frame 11.

In the embodiment depicted, the typical dimensions of the extremes of the apparatus might be 500 mm×800 mm. However, the apparatus may be provided in any size depending upon the particular application.

In use, the frame 11 may be generally aligned with the location upon the surface to be printed. The surface may be a glass window, door, a wall, a ceiling, a floor or any surface upon which printing is desired. Once generally aligned, the suction cups 15 might be activated by the levers (not shown) to secure the same against the surface, thus rigidly securing the frame 11 in position. The positioners indicated in FIG. 1 by reference numeral 13 might be rotated out of the way. The positioners indicated by numeral 12 at the left hand and lower edges of the frame 11 may be rotated into position and aligned with the left hand and lower edges of screen print frame 16. Once the frame 16 is accurately positioned the tightening of 18 may be tightened to firmly secure the positioners 12 against rotation. At this point, the positioners indicated by numeral 13 may be brought into contact with the remaining edges (the upper and right hand edges) of the print screen 16.

The screen printer would then be used in a conventional manner to apply an image to the surface. It would be up to the user to decide upon an appropriate mesh count of screen 17 in the screen printer frame 16.

Where only one color is required, the apparatus 10 might simply be removed by activation of the suction cup levers.

However, where an image of multiple color is desired, the positioners 13 might simply be retracted to allow removal of screen printer frame 16. It is important at this point that positioners 12 are not moved.

At this stage, a second identical printing screen 16 prepared for a print of a second color may be placed into position upon the frame against positioners 12 after an appropriate drying time of the first print has elapsed. Similarly, third and more colors may be printed to create an image of multiple color.

As an alternative, the positioners 12 might be done away with altogether. The only difference in operation would be that the overall frame 11 would need to be more accurately adjusted before affixing to the surface. A series of buffers may be provided in the location of each positioner 12. Alternatively, the screen printer frame might simply reside hard against the left and bottom edges of the frame 11.

It should be appreciated that modifications and alterations obvious to those skilled in the art are not to be considered as beyond the scope of the present invention. For example, separate clamping devices may be fixed to the frame 11 to provide a force upon the screen print frame 16 normal to the surface to be printed. That is, it might be desirable to provide some additional force to hold the frame 16 down upon the surface to be printed, other than simply holding the frame laterally by positioners 12 and 13.

Furthermore, the apparatus may be used for processes other than the application of printed matter to a surface. For example, an etching process might also be conducted by use of the apparatus herein. In addition, an etching process might be combined with a printing process to result in a hybrid image upon a smooth surface. Such might be accomplished simply by using the apparatus to print one or more colored images as well as to etch the same surface.

I claim:

1. An image printing apparatus comprising:

a frame defining a hollow space within which a printing screen having side edges, top and bottom edges, can be received, a fastening device fixed to the frame and including a surface engagable element for selectively holding the frame stationary relative to a surface, adjustable positioners mounted to the frame, said positioners including printing screen-cooperating elements cooperating with the respective side edges of the screen so as to adjust the position of the screen in a first direction with respect to the frame and others of the positioners being adapted to cooperate with the respective top or bottom edges of the screen so as to adjust the position of the screen in a second direction normal to said first direction relative to said frame so as to position the screen to be ready for application of an image to said surface, and said adjustable positioners comprising a series of cam devices rotatably mounted to the frame and having a printing screen edge-camming surface.

2. The image printing apparatus of claim 1 wherein the fastening device comprises suction cups.

3. The image printing apparatus of claim 2 wherein the suction cups each comprise an activation lever.

4. The image printing apparatus of claim 1 wherein the adjustable positioners comprise a series of threaded fasteners passing through the frame and adapted to bear against edges of the printing screen.

5. The image printing apparatus of claim 4 wherein the threaded fasteners are provided with lock nuts.

6. The image printing apparatus of claim 1 wherein the adjustable positioners comprise:

threaded shafts upon which each cam device is pivotally mounted; and a locking nut upon the threaded shaft.

7. An image printing apparatus, for use with a printing screen having first, second, third and fourth sides, said first side adjacent said second and fourth sides and opposite said third side, comprising:

a frame defining a printing screen-receiving opening;

a frame fastener for selectively securing the frame to a surface;

adjustable positioners, carried by the frame, comprising printing screen-cooperating elements cooperable with sides of a printing screen so to enable the printing screen to be positionable in first and second directions, said first and second directions being transverse to one another; and said adjustable positioners comprising a series of cam devices rotatably mounted to the frame and having a printing screen edge-camming surface.

8. The image printing apparatus of claim 7 wherein said printing screen-receiving opening is rectangular.

9. The image printing apparatus of claim 7 wherein said frame fastener comprises a suction device.

10. The image printing apparatus of claim 7 wherein said adjustable positioners are engagable with each of the first, second, third and fourth sides.

11. The image printing apparatus of claim 7 wherein said first and second directions are perpendicular to one another.

12. The image printing apparatus of claim 7 wherein two of said adjustable positioners are carried by the frame and are positioned to be cooperable with said first and second sides.

13. The image printing apparatus of claim 12 wherein two of said adjustable positioners are carried by the frame and are positioned to be cooperable with said third and fourth sides.

14. A method of printing an image of multiple color upon a substantially flat surface, the method comprising:

providing an image printing apparatus of the type comprising: a frame defining a printing screen-receiving opening; a frame fastener for temporarily securing the frame to a surface; and adjustable positioners, carried by the frame, adapted to be cooperable with sides of a printing screen;

selectively securing said image printing apparatus adjacent a surface;

mounting a printing screen within the printing screen-receiving opening, said mounting step comprising the step of positioning, using the positioners, the printing screen in first and second directions, said first and second directions being transverse to one another, the printing screen having first, second, third and fourth sides, said first side adjacent said second and fourth sides and opposite said third side;

printing a first colored image upon the surface using the printing screen;

removing the printing screen from the frame without readjusting preselected ones of said adjustable positioners;

mounting a further printing screen to the frame and aligning the further screen with the first colored image by contacting the further screen with said non-readjusted positioners; and printing a second colored image.

15. A method of printing an image upon a substantially flat surface, the method comprising:

providing an image printing apparatus of the type comprising: a frame defining a printing screen-receiving opening; a frame fastener for temporarily securing the frame to a surface; and adjustable positioners, carried by the frame, adapted to be cooperable with sides of a printing screen;

selectively securing the image printing apparatus adjacent a surface;

mounting a printing screen within the printing screen-receiving opening, said mounting step comprising the step of positioning, using the positioners, the printing screen in first and second directions, said first and second directions being transverse to one another, the printing screen having first, second, third and fourth sides, said first side adjacent said second and fourth sides and opposite said third side; and applying an image to the surface by use of the printing screen.

* * * * *